US005250138A

United States Patent [19]

Szewczyk et al.

[11] Patent Number: 5,250,138

[45] Date of Patent: Oct. 5, 1993

[54] LABEL APPLICATOR HAVING AUTOMATIC HEIGHT POSITIONING

[75] Inventors: Richard S. Szewczyk, Madison; Joseph R. Vivirito, South Windsor, both of Conn.

[73] Assignee: Gerber Garment Technology, Inc., Tolland, Conn.

[21] Appl. No.: 682,439

[22] Filed: Apr. 8, 1991

[51] Int. Cl.[5] ..... G05G 21/00

[52] U.S. Cl. ..... 156/350; 156/361; 156/362; 156/538; 156/574; 156/363; 156/364; 156/367

[58] Field of Search ..... 156/350, 361, 362, 538, 156/574 L, 360, 364, 363, 510, 523, 530, 543

[56] References Cited

U.S. PATENT DOCUMENTS

| | | | |
|---|---|---|---|
| 3,765,349 | 10/1973 | Gerber | 112/121.14 |
| 4,028,167 | 6/1977 | Gerber | 156/510 |
| 4,285,752 | 8/1981 | Higgins | 156/350 |
| 4,294,644 | 10/1981 | Anderson | 156/361 |
| 4,834,824 | 5/1989 | Tiedeck | 156/350 |
| 4,857,121 | 8/1989 | Markley et al. | 156/361 |

*Primary Examiner*—David A. Simmons
*Assistant Examiner*—Merrick Dixon
*Attorney, Agent, or Firm*—McCormick, Paulding & Huber

[57] ABSTRACT

A top ply labeler includes a presser foot and applicator pad which are arranged for relative movement to one another travel along a rectilinear path as the ram of an applicator cylinder is extended and retracted toward and away from the top surface of a lay-up of sheet material whereby a label carrying identification information are applied at predetermined positions. The applicator cylinder is mounted to the applicator backplate for relative vertical movement toward and away from the top ply surface to maintain the labeller at a desired elevation above the top ply. A vane carried by the pressure foot is detected by a sensor carried on the applicator pad when the pressure foot contacts the surface of a top ply. As the applicator pad continues its downward movement, the pressure foot and vane move relative to the applicator pad until such time as the vane is detected by the applicator pad sensor to apply to the label and stop the downward movement. The applicator cylinder retracts the applicator pad and pressure foot carrier. The labeller is driven in the Z-axis direction when the ram of the applicator cylinder is fully extended without the pressure foot making contact with the surface of the top ply.

6 Claims, 8 Drawing Sheets

LABEL APPLICATOR HAVING AUTOMATIC HEIGHT POSITIONING

BACKGROUND OF THE INVENTION

The present invention relates generally to automatically controlled cutting equipment of the type used to generate multiple pattern pieces from a lay-up of sheet material. More particularly, the present invention deals with apparatus for automatically positioning a top ply label applicator at a desired elevation or distance above the surface of the top ply of sheet material to apply information labels to stacks of pattern pieces cut from the lay-up.

It is well known in the cutting of sheet material, particularly limp sheet material such as cloth, to use computer assisted means to produce a marker indicating the shapes and arrangements of parts to be cut from a quantity of work material. The information inherent in the marker is then processed in combination with ancillary input data to provide a set of marker instructions or a drawn marker, usable by a cutting system. The cutting system generally includes means for spreading a single sheet, or a lay-up of sheet material to be cut and an automatically controlled cutting machine using the marker instructions or a manually controlled cutting machine using the drawn marker as a pattern for cutting the spread material into the desired shapes. The cutting system also generally includes a labeller of some type, to apply identification labels to the top surface of the work material, either before or after the cutting, to identify the parts cut from the material. In cases were the work material is a lay-up of sheets, each part cut from the material actually consists of a stack of individual pieces. An apparatus and method for making a marker representation is shown, for example, in U.S. Pat. No. 3,887,903. Labelling devices for use with sheet material cutting systems are shown by U.S. Pat. Nos. 4,028,186; 4,189,337 and 4,514,246. As evident from the referenced patents, the labeller is mounted either on the same carriage as a cutting head or on the carriage of the spreader to control the positioning and operation of the labeller through the same controller as used to control the cutting head or spreader. A labelling apparatus wherein the apparatus is a unitary self-driven and self-controlled module capable of easy transfer from one point of use to another without requiring control cabling and connection to separate control equipment is disclosed in a pending U.S. patent application Ser. No. 585,711, filed Sep. 19, 1990 and titled "Labelling Apparatus and Method for a Sheet Material Cutting System and a Supply of Labels for Use Therewith" and assigned to the same assignee as the present invention.

Typically, the height of the lay-up of sheet material spread varies along the length of the lay-up for the reason that the number of sheets spread is different to accommodate the different number of plies associated with the various different patterns identified by the marker. Generally, the sheet material is spread to produce decreasing heights along the length of the lay-up but may also be spread to produce increasing heights along the length of the lay-up. Therefore, the elevation of the labeller above the top ply along the lay-up must be continually adjusted to accommodate the different ply heights so that the labeller apparatus may properly apply the identification label to the top ply of the stack to be identified. Accordingly, the rate of label application and output of the work pieces is significantly reduced due to the continual readjustment of the labeller above the top ply during the cutting and labelling processes.

It is a general aim of the present invention therefore to provide an improved labeller apparatus which automatically adjusts its elevation above the top ply surface of a lay-up of sheet material to accommodate ply height variations along the length of the lay-up.

SUMMARY OF THE INVENTION

In accordance with the present invention, labeller apparatus for applying labels to the uppermost ply supported on the support surface of a sheet material processing system upon which one or more plies of a sheet material are supported includes means defining a labeller assembly for providing identification labels to be applied to the top ply surface of a lay-up of the sheet material to identify pattern parts cut therefrom. The labeller apparatus is generally supported by a work carriage for coordinated movement in the X-Y direction and further includes means for supporting the labeller assembly for relative vertical movement toward and away from the sheet material support surface. The labeller assembly further includes means for sensing the surface of the uppermost ply of the lay-up and means operating in response to the surface sensing means to position the labeller assembly a predetermined distance above the uppermost ply surface.

The labeller can include a means defining an applicator pad for receiving, carrying and applying a label. The surface sensing means and applicator pad are advanced and retracted along a rectilinear path toward and away from the support surface. Means are provided for detecting the contact between the surface sensing means and the uppermost ply when the surface sensing means and applicator pad means are advanced towards the support surface. Means responsive to the first detecting means moves the labeller assembly toward the support surface when the surface sensing means does not contact the surface of the uppermost ply and the advancing and retracting means has fully advanced the surface sensing means and applicator pad toward the support surface.

In a further aspect of the invention, the surface sensing and applicator pad means may be rotated 90 degrees to the normal direction of label application to orient the label placement to accommodate a given size and shape of the cut pattern pieces.

BRIEF DESCRIPTION OF THE DRAWINGS

Other features and advantages of the present invention will be readily apparent from the following written description and drawings wherein.

DESCRIPTION OF THE PREFERRED EMBODIMENT

Figure 1:
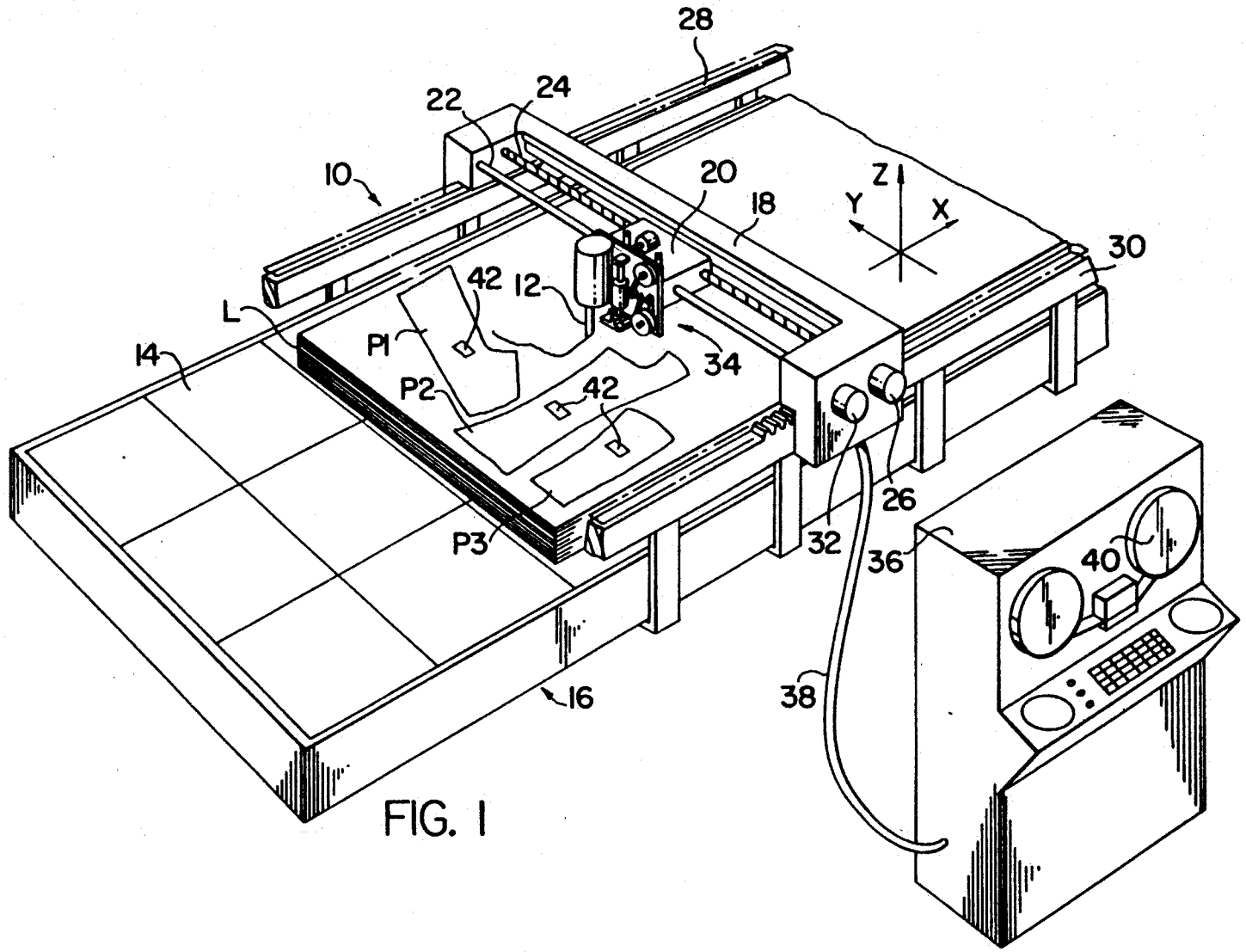
FIG. 1 is a perspective view of an automatically controlled cutting machine wherein a labeller apparatus embodying the present invention is mounted to move with the work carriage and cutter.

Turning now to the drawings and considering the invention in further detail, the labeller apparatus may be utilized with an automatically controlled cutting machine such as the machine illustrated in FIG. 1 and generally designated 10 wherein a plurality of pattern pieces P1, P2, etc.. are cut from a lay-up L of limp sheet material. A cutting tool 12 is suspended above the support surface 14 of a cutting table, generally designated 16, and the lay-up L by a pair of carriages 18 and 20 which move relative to the table 16 in the illustrated X and Y directions. The carriage 20 moves in the Y coordinate direction by means of a guide bar 22 and a lead screw 24 which is driven by the Y drive motor 26. The carriage 18 moves in the X coordinate direction on a pair of rack gears 28,30 over the table 16 and is driven by the X drive motor 32.

The labeller apparatus embodying the present invention is generally designated 34 and is carried by the work carriage 20 for movement with the work carriage 20 and cutter 12 in the X and Y coordinate directions. The labeller apparatus is also arranged for movement in the Z-axis direction as explained below. Command signals controlling the drive motors 26 and 32 and correspondingly the positions of the carriages 18 and 20 and the cutting tool 12 and labeller assembly 34 carried by the carriage 20, are transmitted to the cutting machine 10 from an automatic controller 36 through a control cable 38. The controller 36 may be a numerical controller which operates from a program tape 40 which defines the profile peripheries of the pattern pieces to be cut from the lay-up and further controls the actuation of the labeller assembly 34. It will be understood that the controller 36 is well known to those skilled in the art and may be embodied in various devices having means for storing an instruction set which is used to control the movement of the respective carriages and actuation of the labeller assembly 34. At each of the pattern pieces P1,P2 a label 42 containing the necessary identification information for each of the pattern pieces cut, is attached to the top ply of the stack of the pattern pieces. The labels 42,42 may be applied by the labeller apparatus 34 in the Y coordinate direction or the X coordinate direction as required as will be explained in further detail hereinbelow.

Figure 2:
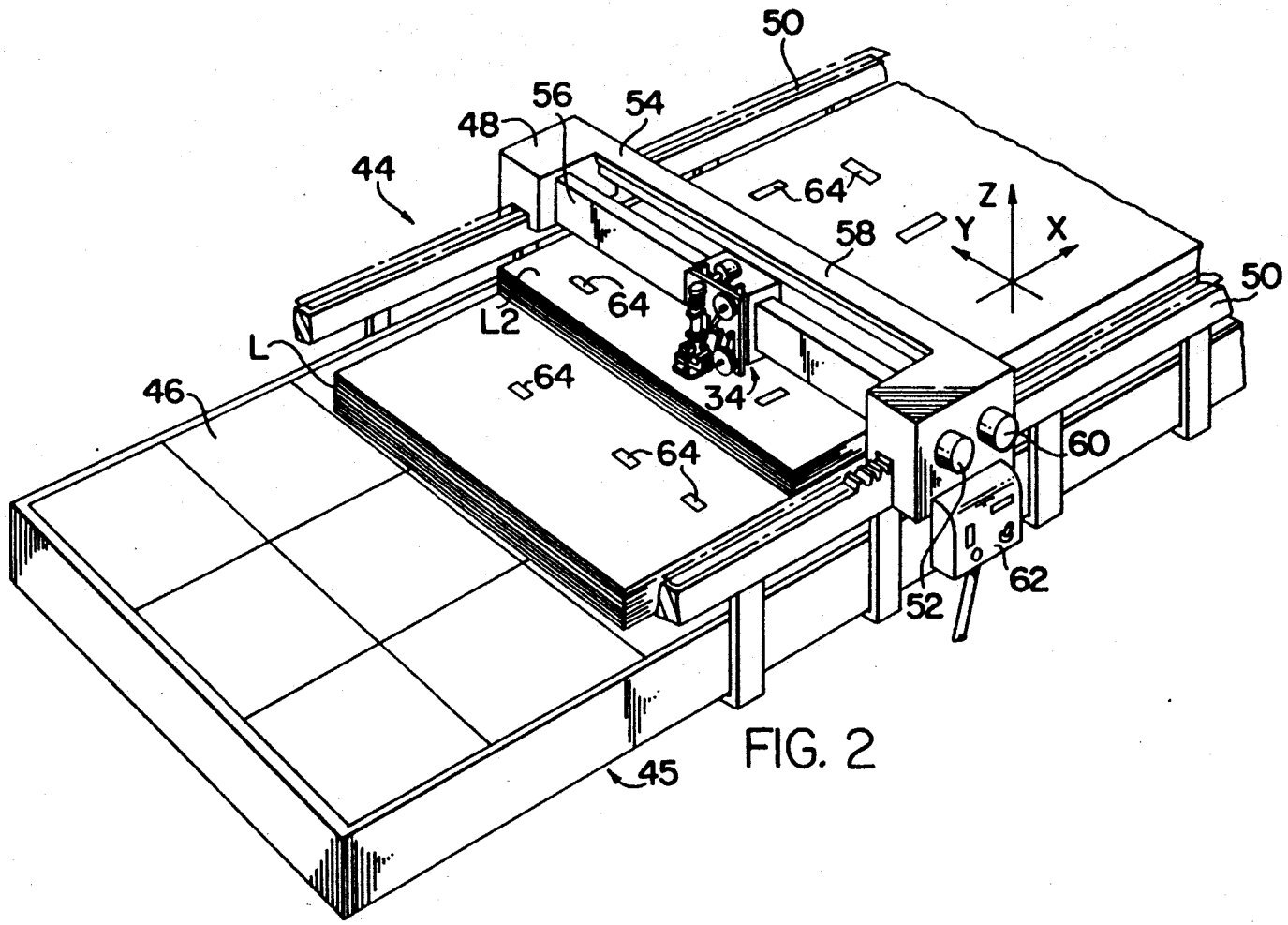
FIG. 2 is a perspective view of a cloth spreader system wherein a labeller apparatus embodying the present invention is mounted for movement on a work carriage independent of the movement of a cutter which may be present.

As illustrated in FIG. 2, the labeller apparatus 34 is used with a cloth spreader system generally designated 44 which includes a spreading table 45 which has a supporting surface 46 upon which the sheet material to be cut is spread and as illustrated comprises a lay-up L of a number of sheets of sheet material superimposed on one another. As illustrated in FIG. 2, the lay-up L of sheet material may be spread in such a manner that the height of the plies increase or decrease in a direction of label application along the length of the table 45 as is well known to those skilled in the art. The second lay-up is generally designated by L2 in FIG. 2 and illustrates a second height of spread material above the support surface 46. Although the spreading table 45 is shown for convenience to be relatively short in FIG. 2, a typical installation may have a table length of 50 feet or more over which the height of the lay-up varies in accordance with the number of plies which comprise the lay-up at various position along the length of the lay-up.

As shown in FIG. 2, the labeller apparatus 34 includes a labelling carriage 48 supportable by guide rails 50,50 of the spreader table 45 for movement in the X coordinate direction and includes pinions driven by a Y drive motor 52 meshing with the racks of the guide rails 50. The carriage 48 also includes a structural beam 54 and a guide rail 56 extending transversely over the supporting surface 46. The guide rail 56 supports a work carriage 58 for movement along its length, illustrated in the Y coordinate direction, and carries the labeller apparatus 34. Movement of the work carriage 58 along the length of the guide rail 56 is affected by a suitable drive means including a Y drive motor 60. The labeller apparatus 34 is also mounted for movement in the Z-axis direction. A controller generally designated 62 is carried on one end of the carriage 48 and operates in accordance with an instruction set to control the movement and actuation of the labeller apparatus 34 and the movement of the carriages 48 and 58 respectively, to position the labeller apparatus as required in accordance with the positions identifying the pattern pieces to be cut. The labels are designated 64,64 in FIG. 2. For further details of a labelling apparatus as illustrated in FIG. 2, reference may be had to the above-identified co-pending patent Ser. No. 585,711 and which disclosure is incorporated herein by reference.

Turning now to FIGS. 3-9, the labeller apparatus embodying the present invention is described in further detail. The labeller apparatus is designated generally 70 and includes a labeller backplate 72 carried by the work carriage 58 by means of two guide bushings 76,76 fixed to the carriage 58 and two guide rods 74,74 fixed to the labeller backplate and slidably received by the bushings 76,76 to permit vertical sliding movement of the labeller backplate relative to the work carriage 58. A label supply spool 78 for holding label supply means in the form of an elongated strip of suitable label material means 80 is mounted to the labeller backplate 72. Also mounted to the labeller backplate 72 is a tensioning roller means 82, guide roll 84, label cutting and feeding mechanism generally designated 86, return guide roller 88 and a label take-up spool 90. A motor 92 and suitable drive means powers the take-up spool 90.

The label applicator and sensor assembly generally designated 94 is driven along a rectilinear path by an application cylinder 96 which may be electrically or pneumatically actuated. The applicator cylinder 96 is mounted for pivotal movement by mounting flanges 98 and 100, respectively fixed to the labeller backplate 72. The applicator cylinder 96 includes a shaft 102 which is fixedly attached to a collar portion 104 at the upper end of the applicator cylinder 96 and which shaft 102 passes through a bushing 106 in the mounting flange 98 and through bushing 108 mounted in the mounting flange 100. The opposite end 110 of the shaft 102 is fixedly connected to a coupling 112. A motor generally designated 114 is mounted to the labeller backplate 72 and includes a drive shaft 116 which is also received by the coupling 112 and is fixedly connected thereto. The motor 114, drive shaft 116, shaft 102 and the applicator cylinder 96 are in axial alignment. The motor 114, when actuated as explained in further detail below, is used to rotate the label applicator and sensor assembly to apply a label in a 90 degree orientation relative to the normal direction of label application.

The label applicator and sensor assembly 94 includes a presser foot 118, an applicator pad 120, an actuator vane 122 mounted to the presser foot 118. The vane 122 is in alignment with a presser foot detection sensor means 124 and a label applicator pad detection sensor means 126 both of which are carried by the applicator pad 120. The sensors 124,126 may be optical sensors, magnetic proximity switches or other suitable devices well known to those skilled in the art. A generally H-shaped carrier 128 has one end 130 connected to the end of a ram 132 associated with the applicator cylinder 96 for movement with the ram 132 in a linear motion thereby carrying the presser foot and applicator pad along a rectilinear path.

The H-shaped carrier 128 has outwardly extending upper arms 134,136 located at an upper end 138 and, outwardly extending arms 140,142 at a lower end 144 opposite the upper end 138 thereby disposing the lower outwardly extending arms 140,142 in a spaced apart parallel relationship with the upper outwardly extending arms 134 and 136, respectively. The outwardly extending arms 134 and 140 have openings 146 and 148 respectively therethrough and in registry with one another and which are dimensioned to pass an axially elongated rod 150 having its upper end 152 extending somewhat beyond the outwardly extending arm 134. The opposite end 154 of the rod 150 is fixedly attached to presser foot 118. The rod 150 is held in place by a locking collar 156 which is located intermediate the outwardly extending arms 134 and 140 and positioned to fix the distance between the lower arm of the carrier 128 and the presser foot 118 such that the upper end 158 of the vane 122 is located just within the presser foot sensor 124 but just out of the sensing position. A spring 160 located between the upper outwardly extending arm 134 and the locking collar 156 provides a bias to urge the collar 156 against the lower extending arm 140 and accordingly, maintains the presser foot in an extended position relative to the applicator pad 120. The outwardly extending arms 136 and 142, respectively, of the carrier 128 likewise have openings 162,164, respectively, in registry with one another and through which a rod 166 substantially identical to the rod 150 passes and which has an upper end 168 extending somewhat beyond the upper outwardly extending arm 136. The opposite end 170 of the rod 166 is fixedly attached to the presser foot 118. A locking collar 172 similar to the collar 156 is attached to the rod 150 to adjust the length of the rod 166 between the arm 142 and the presser foot 118 to maintain the upper end 158 of the vane 122 in the proper location relative to the sensor 124 and to maintain the presser foot substantially parallel to the surface over which it travels. A spring 174 similar to the spring 160 is located intermediate the arms 136 and the locking collar 172 to urge the collar into contact with the lower arm 142 and thereby biases the presser foot 118 toward an extended position relative to the applicator pad 120.

The applicator pad 120 is also carried by the carrier 128. In the illustrated embodiment, the applicator 120 is releasably attached to the lower extending arms 140,142, respectively, by means of longitudinally extending pins 186,188, respectively, which pass through opposite ends of the applicator pad and through the arms. It is seen that the presser foot 118 and applicator pad 120 are arranged for relative movement with respect to one another.

Figure 4:
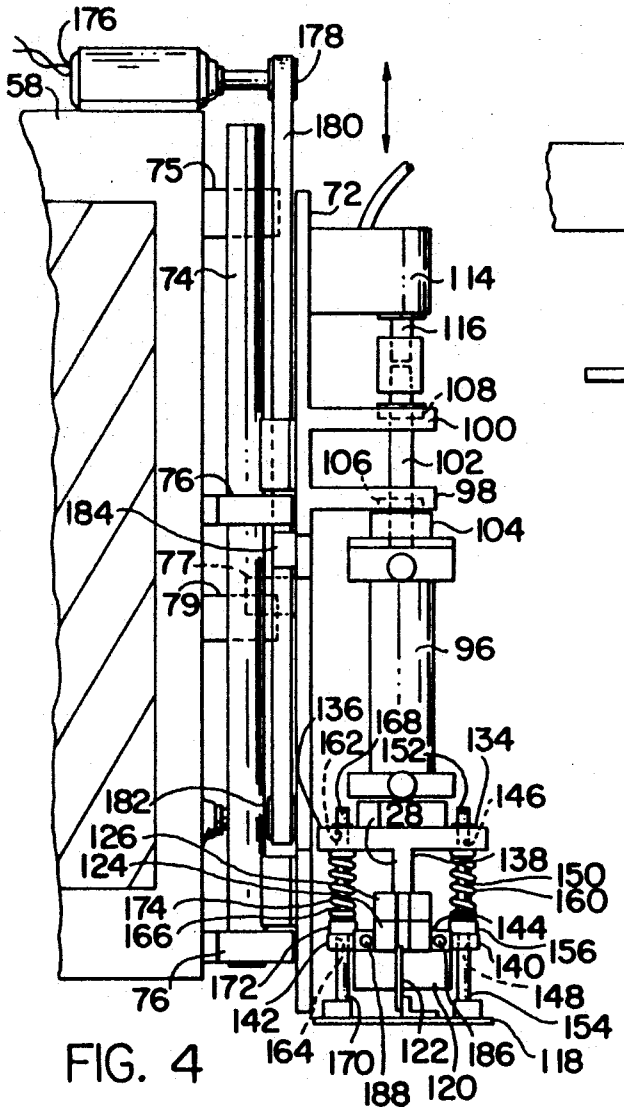
FIG. 4 is a side elevation view of the labeller apparatus of FIG. 3 and showing it arranged for vertical movement in the Z-axis direction toward and away from a surface over which the labeller moves.
Figure 6:
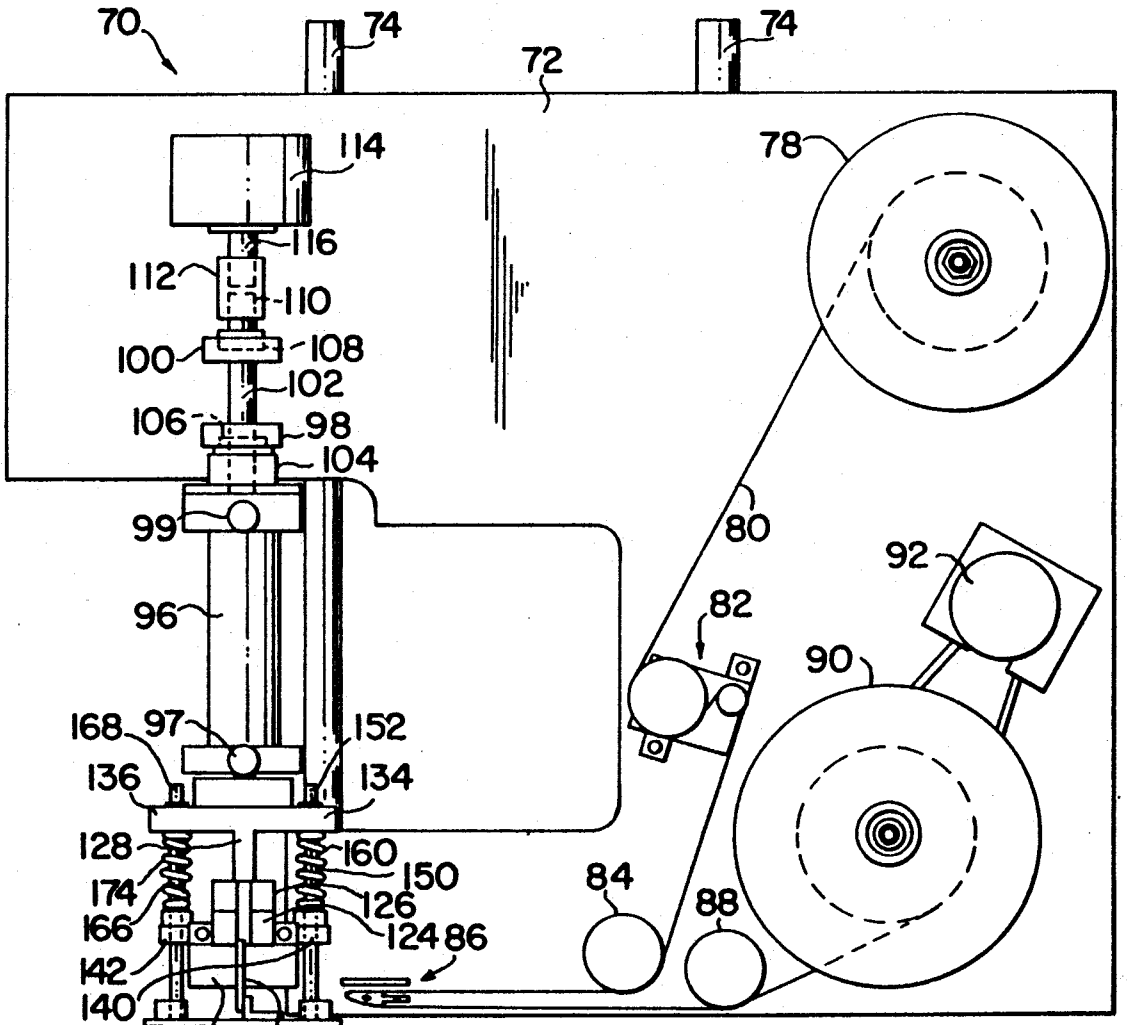
FIG. 6 is a front elevation view of the labeller apparatus of FIG. 3 wherein the applicator pad and presser foot are rotated 90 degrees to the normal direction of label application.

The labeller backplate 72 is raised and lowered in the Z axis direction to maintain the elevation of the presser foot 118 a predetermined and desired distance above the surface over which it travels. Referring to FIG. 4, a reversible drive motor 176 is mounted to the work carriage 58 and is operated in accordance with command signals from the controller. The drive motor 176 turns a drive sprocket 178 to drive a drive belt 180. The drive belt 180 loops around an idler pulley 182 which is mounted to the work carriage 58 in a spaced relation to the drive sprocket. The drive belt 180 has a coupling 184 to secure it and the belt to the labeller backplate 72. It can be seen that when the drive motor 176 is operated in one direction, the drive pulley 178 causes the belt to turn in a direction to raise the labeller and when rotated in the opposite direction lowers the labeller.

The labeller apparatus also includes a first upper sensor for limiting the movement in the Z-axis direction vertically upward and a second lower sensor for limiting the downward movement in the Z-axis direction toward the surface over which the labeller travels. As illustrated in FIG. 4, the upper height and lower height sensors are indicated at 75 and 79, respectively and each are attached to the face of the work carriage 58 in a spaced relationship and extend toward the labeller backplate 72. A vane 77 attached to the labeller backplate 72 extends toward the work carriage 58 and is in registry with the upper sensor 75 and lower sensor 79. The sensors may comprise an optical sensor, photo interrupter, magnetic proximity switch, or other devices well known to those skilled in the art. In operation, the labeller backplate 72 is moved in the Z-axis direction upward when the Z-axis drive motor 176 is operated. The vane 77 is detected by the sensor 75 which provides a voltage signal to the controller which in turn provides a command signal to cause the Z-axis drive motor 176 to turn off and corresponds to the uppermost position that the labeller backplate can be moved to during operation. Likewise, the labeller backplate moves in the Z-axis direction downward toward the support surface until such time that the vane 77 is detected by the sensor 79 to provide an output voltage signal to the controller which in turn provides a command signal to deactivate the Z-axis drive motor 176. This lower limit position represents the lowermost position that the labeller apparatus can move toward the support surface over which it travels.

Figure 3:
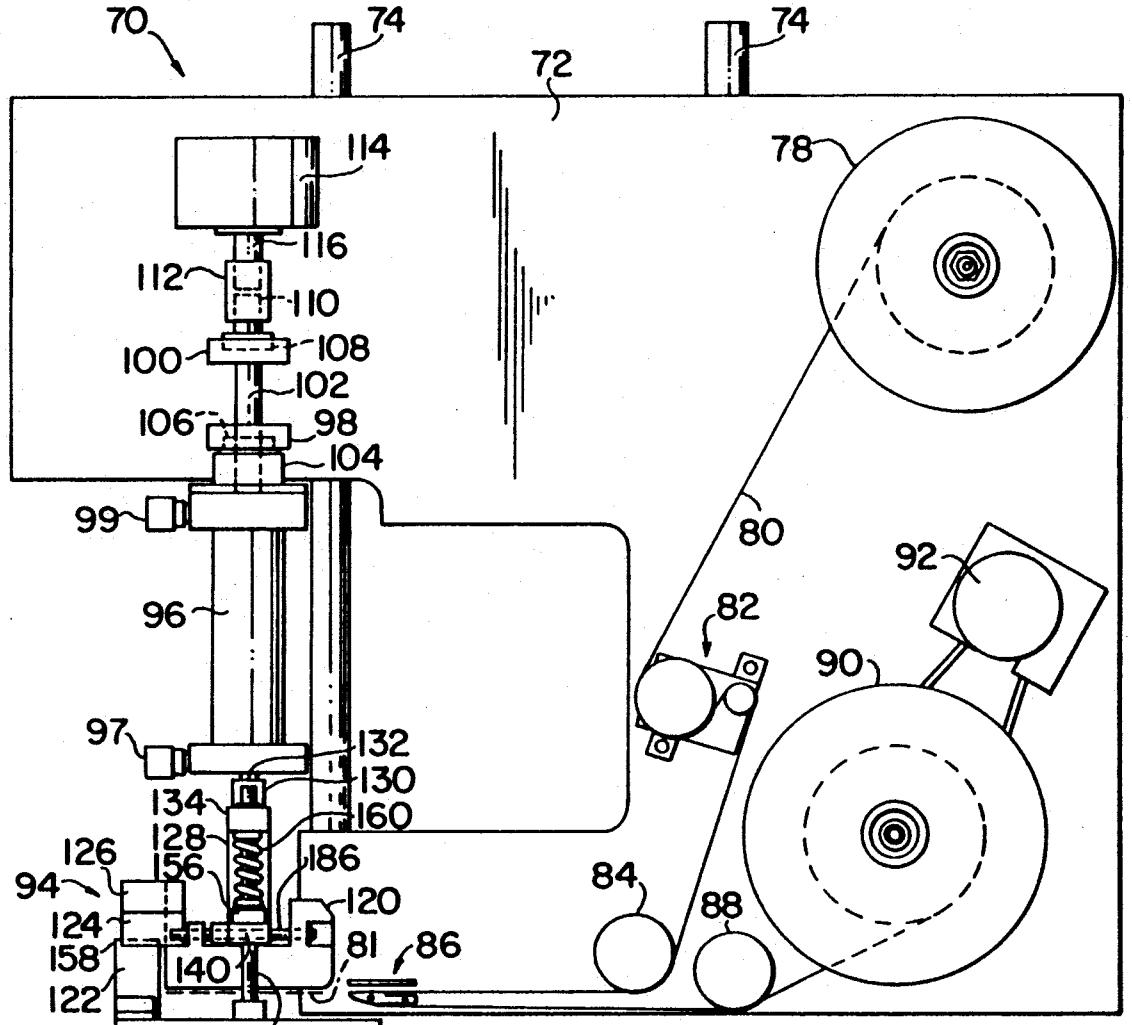
FIG. 3 is a front plan view of a labeller apparatus embodying the present invention and illustrating the presser foot, applicator pad and application cylinder in a fully retracted state.
Figure 5:
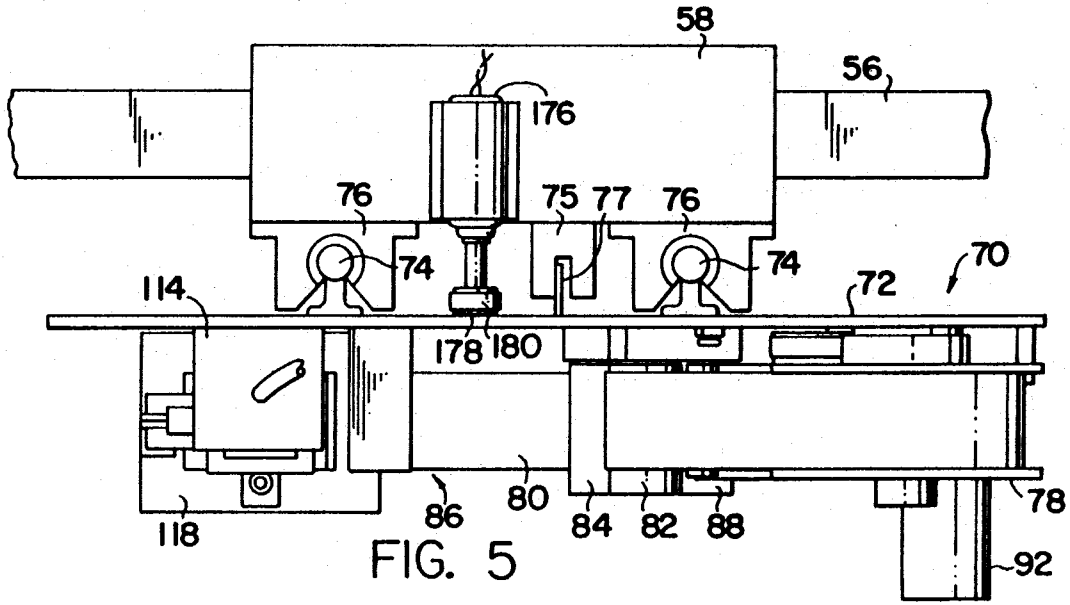
FIG. 5 is a top plan view of the labeller apparatus of FIG. 3.
Figure 7:
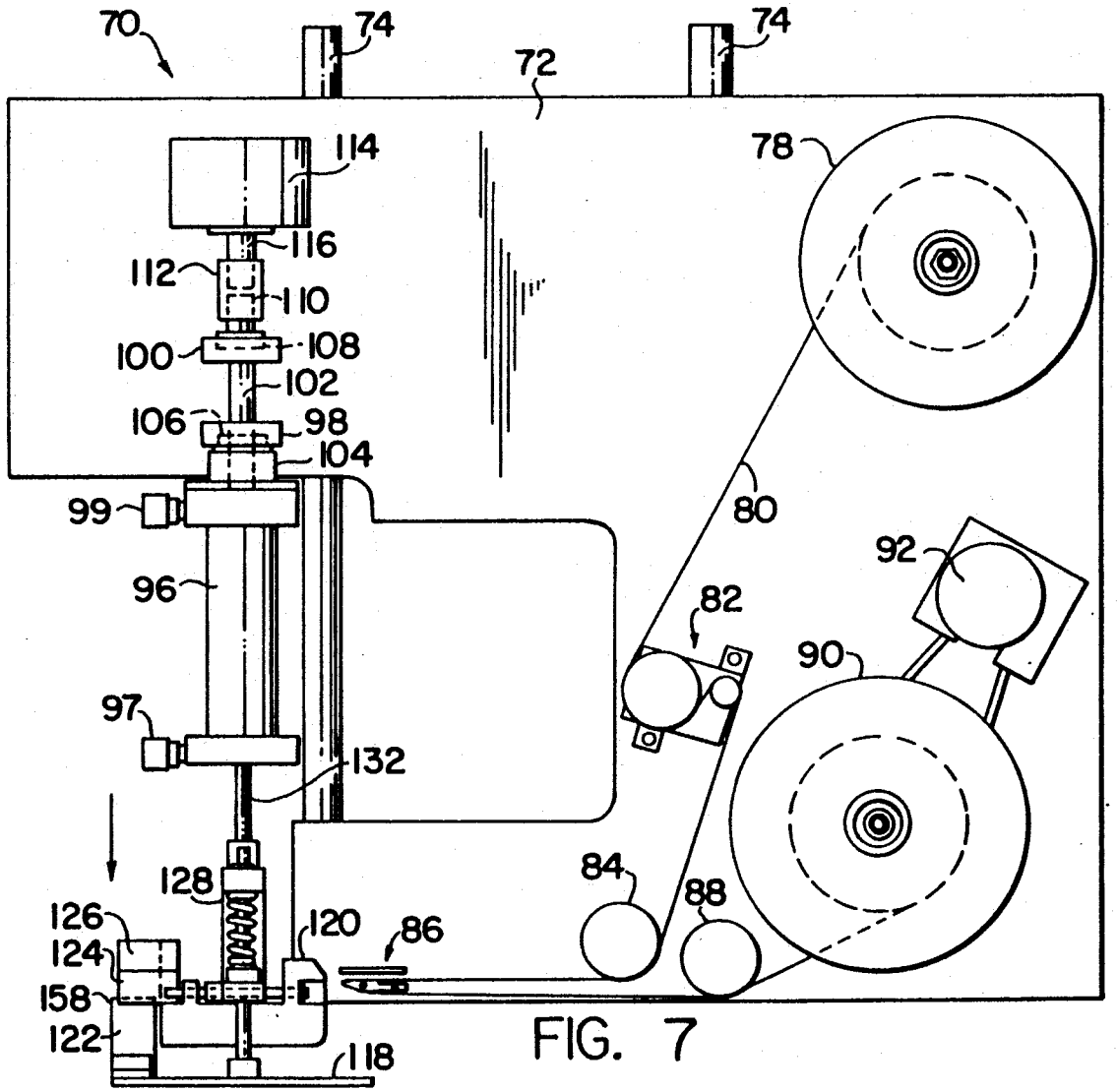
FIG. 7 and FIG. 8 are front elevational views of the labeller apparatus of FIG. 3 illustrating the presser foot and applicator pad in an intermediate travel position and an extended travel position to apply a label to a top ply surface.
Figure 8:
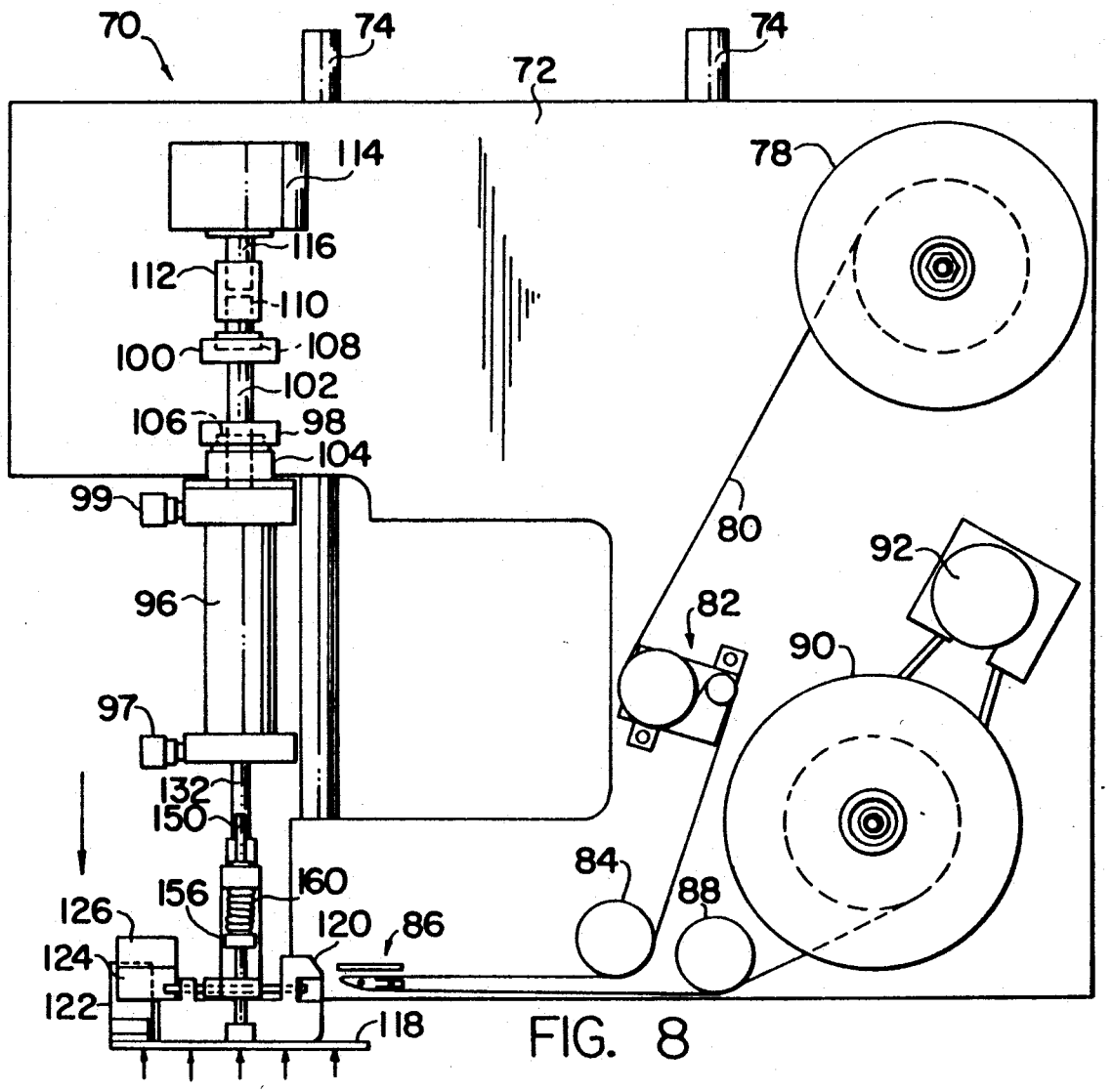

As illustrated in FIG. 3, a label 81, shown in phantom, is cut and positioned below the applicator pad 120 in a manner well known to those skilled in the art for movement with the applicator pad. In operation, the applicator cylinder 96 is actuated to extend the ram 132 downwardly toward the surface over which the labeller passes carrying with it the presser foot 118 and the applicator pad 120 as illustrated in FIGS. 7 and 8. When the ram 132 is extended sufficiently to cause the presser foot 118 to contact the surface over which the labeller moves, the upper end 158 of the vane 122 moves sufficiently into the label applicator pad sensor 126 so that the vane is detected causing the sensor to provide an output signal to the controller indicating that the applicator pad has contacted the surface. At that point the applicator pad has passed below the presser foot to apply the label. The applicator cylinder 96 now reverses direction of the ram 132 to raise the presser foot 118 and applicator pad 120 to its retracted position as shown in FIG. 3. This process is repeated at each position to apply the required label.

In circumstances where the labeller backplate is elevated above the surface of the top ply at a displacement which exceeds the extended length of the ram 132 of the applicator cylinder 96 such that the presser foot 118 does not contact the surface, an extend limit sensor 97 associated with the applicator cylinder 96 detects that the ram 132 is extended to its full length and provides a signal to the controller indicating that the cylinder is in a fully extended state. The fully extended state signal together with the absence of any signal from the presser foot sensor 124 and label applicator pad sensor 126 is detected by the instruction set in the controller and is recognized as indicating the labeller apparatus is out of range to apply a label.

The extend limit sensor 97 provides a retract voltage signal to the controller which in turn provides a voltage command signal to activate the Z-axis drive motor 176 to operate the motor in the proper direction. The labeller backplate 72 moves downwardly until presser foot 118 lists the material causing vane 122 to move upwardly and make contact to activate presser foot detector 124. A retract signal generated by the controller activates the applicator cylinder 96 to retract the ram 132 to a fully retracted position which is detected by a retract sensor 99 associated with and located on the applicator cylinder and at the end of the applicator cylinder furthest from the presser foot. The Z axis motor continues to operate driving the assembly down a predetermined distance such that the presser foot is in a retracted position about one half inch above the surface. Now the label can be applied as set forth above.

Since the lay-up may be spread in a direction of decreasing height or increasing height, the controller can be programmed with input data in accordance with the marker information such that as the labeller is moved to an area were the ply height increases, the Z-axis drive motor 176 is activated to raise the labeller backplate 72 to provide the desired clearance above the top ply. The above described process of extending the ram 132 and detecting the actuation of the presser foot sensor and label applicator pad sensor is repeated to adjust the height of the labeller assembly above the top ply to be within the desired distance above the top ply.

Figure 9:
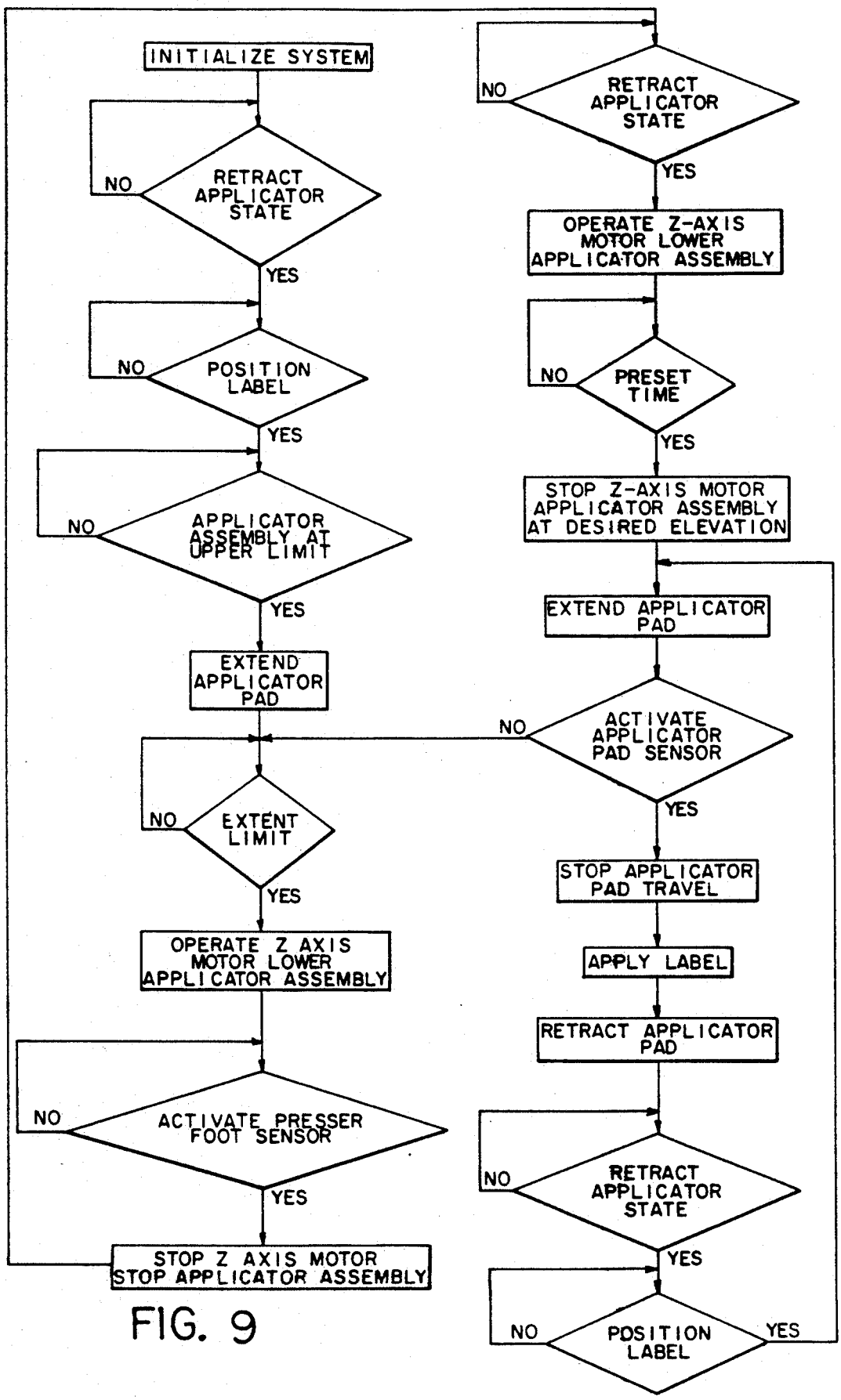
FIG. 9 is a flowchart showing the method of operation of the labeller apparatus of the present invention.

FIG. 9 shows generally the method of the height adjustment of the labeller as described above. As shown by this figure, the first step in the method is to initialize the system by retracting the ram of the applicator cylinder to its fully retracted state. A label is then positioned under the applicator pad and the Z-axis drive motor is operated to move the labeller backplate to its uppermost limit position as detected by the upper height sensor. The ram of the applicator cylinder is extended to its limit and the Z-axis motor is then operated to lower the labeller backplate. When the presser foot contacts the surface and actuates the presser foot sensor, the Z-axis motor is turned off. The applicator cylinder next retracts the ram and presser foot and applicator pad to its fully retracted position. The Z-axis motor is then operated to lower the labeller backplate to the desired elevation as programmed in the instruction set. The applicator cylinder is operated to move the applicator pad and presser foot toward the surface until such time that van 122 is sensed by the applicator pad sensor 126 which stops the travel of the applicator pad and causes the label to be applied. The applicator pad and presser foot are now retracted by the applicator cylinder to the fully retracted position. The labeller now is moved to the next position at which a label is to be applied and the process is repeated for each such position.

Apparatus for automatically positioning a top ply label applicator at a desired elevation above the surface of the top ply of a lay-up to apply information labels to stacks of pattern pieces cut from the lay-up is disclosed above in a preferred embodiment. It will be recognized that numerous changes and modifications may be made without departing from the spirit and the scope of the invention and therefore the invention is described by way of example rather than limitation.

We claim:

1. In combination with a sheet material processing system having a controller, a support surface upon which one or more plies of a sheet material are supported thereon, and a work carriage for movement relative to the support surface, labeller apparatus for applying labels to the uppermost ply supported on the support surface, said apparatus comprising:

means defining a labeller assembly;

means for supporting said labeller assembly for relative vertical movement between said labeller assembly and the sheet material support surface and for relative horizontal movement between said labeller assembly and the support surface;

said labeller assembly supporting means further being supported by the work carriage for relative vertical movement between said labeller assembly supporting means and sheet material support surface whereby said labeller assembly supporting means moves vertically relative to said sheet material support surface and whereby said labeller assembly moves vertically relative to said sheet material support surface and said labeller assembly supporting means;

said labeller assembly further including:

means for sensing the surface of the uppermost ply supported on the support surface, and means operating in response to said surface sensing means to position said labeller assembly a predetermined distance above said uppermost ply surface and for maintaining said labeller assembly in a non-contact spacial relationship with said uppermost ply surface said responding means automatically and without operator intervention re-positioning said labeller assembly supporting means and said labeller assembly said predetermined distance above said uppermost ply surface each time said surface sensing means senses said uppermost ply surface to maintain said labeller assembly in said non-contact spacial relationship with said uppermost ply to permit passage of said labeller assembly over different elevations of said uppermost ply surfaces as said labeller apparatus moves relative to said work surface.

2. Labeller apparatus as defined in claim 1 wherein said labeller assembly further includes:

means for defining an applicator pad for receiving, carrying and applying a label;

means for advancing and retracting said surface sensing means and said applicator pad means along a rectilinear path toward and away from the support surface; and means for detecting contact between said surface sensing means and the uppermost ply surface when said surface sensing means and applicator pad means are advancing toward the support surface.

3. Labeller apparatus as defined in claim 2 wherein said labeller assembly further includes:

means response to said detecting means for activating said advancing and retracting means to retract said surface sensing means and applicator pad means away from the support surface.

4. Labeller apparatus as defined in claim 1 wherein said advancing and retracting means comprises a cylinder having a ram.

5. Labeller apparatus as defined in claim 1 wherein said surface sensing means further comprises a presser foot and a vane coupled to said presser foot, said detecting means further comprising a first sensor carried by said applicator pad and in registry with said vane, said first sensor providing a voltage signal representative of said presser foot contacting the surface of the top ply in response to said vane being detected by said first sensor.

6. Labeller apparatus as defined in claim 2 wherein said cylinder is pivotally mounted for rotation about its longitudinal axis, said longitudinal axis being substantially perpendicular to the support surface, rotational drive means coupled to said cylinder for rotating said cylinder and said applicator pad means a predetermined angular displacement in accordance with a desired label application orientation on the top ply surface.

* * * * *